US011788560B2

(12) United States Patent
Rumpel et al.

(10) Patent No.: US 11,788,560 B2
(45) Date of Patent: Oct. 17, 2023

(54) HYDRAULIC CONTROL BLOCK AND HYDRAULIC SPINDLE COMPRISING SAID CONTROL BLOCK

(71) Applicant: Robert Bosch GmbH, Stuttgart (DE)

(72) Inventors: Manuel Rumpel, Karlstadt (DE); Johannes Schwacke, Bad Orb (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 17/619,413

(22) PCT Filed: Jun. 18, 2020

(86) PCT No.: PCT/EP2020/066925
§ 371 (c)(1),
(2) Date: Dec. 15, 2021

(87) PCT Pub. No.: WO2020/260124
PCT Pub. Date: Dec. 30, 2020

(65) Prior Publication Data

US 2022/0282741 A1 Sep. 8, 2022

(30) Foreign Application Priority Data

Jun. 27, 2019 (DE) ..... 10 2019 209 335.3

(51) Int. Cl.
*F15B 13/02* (2006.01)
*F15B 7/00* (2006.01)
*F15B 21/00* (2006.01)

(52) U.S. Cl.
CPC ..... *F15B 13/02* (2013.01); *F15B 7/001* (2013.01); *F15B 21/00* (2013.01)

(58) Field of Classification Search
CPC ..... F15B 13/02; F15B 21/003; F15B 7/003
See application file for complete search history.

(56) References Cited

U.S. PATENT DOCUMENTS

2003/0097923 A1* 5/2003 Muth ..... F15B 13/0405 91/54
2007/0199604 A1* 8/2007 Haugaard ..... F15B 13/0821 137/884

(Continued)

FOREIGN PATENT DOCUMENTS

DE 25 47 847 A1 5/1977
DE 1199 09 713 A1 9/2000

(Continued)

OTHER PUBLICATIONS

International Search Report corresponding to PCT Application No. PCT/EP2020/066925, dated Sep. 22, 2020 (German and English language document) (5 pages).

(Continued)

*Primary Examiner* — Thomas E Lazo
(74) *Attorney, Agent, or Firm* — Maginot, Moore & Beck LLP

(57) ABSTRACT

The disclosure relates to a hydraulic control block for controlling a pressure medium supply of a hydraulic cylinder of a hydraulic spindle. The hydraulic control block includes a generic hydraulic switching structure electively configurable in each of a plurality of specific hydraulic switching structures, each of the plurality of specific hydraulic switching structures having a respective hydraulic cylinder with a number of piston areas which differs from a number of piston areas in the respective hydraulic cylinders of each of the other of the plurality of specific hydraulic switching structures.

10 Claims, 4 Drawing Sheets

(56) References Cited

U.S. PATENT DOCUMENTS

| | | | | |
|---|---|---|---|---|
| 2020/0240445 | A1* | 7/2020 | Schober | F15B 1/265 |
| 2020/0260128 | A1 | 8/2020 | Gerede et al. | |
| 2020/0260146 | A1 | 8/2020 | Kageyama | |

FOREIGN PATENT DOCUMENTS

| | | | | | |
|---|---|---|---|---|---|
| DE | 10 2017 219 084 | A1 | | 4/2019 | |
| EP | 1 316 732 | A1 | | 6/2003 | |
| WO | 2005/028878 | A1 | | 3/2005 | |
| WO | WO-2020260128 | A1 | * | 12/2020 | F15B 15/18 |
| WO | WO-2020260146 | A1 | * | 12/2020 | F15B 15/18 |

OTHER PUBLICATIONS

Rexroth, Bosch Group, "Servo-Hydraulic Actuator—SHA Fields of Application RE 08137 2018-02," Technical Information Sheet, 2018 (12 pages).

* cited by examiner

HYDRAULIC CONTROL BLOCK AND HYDRAULIC SPINDLE COMPRISING SAID CONTROL BLOCK

This application is a 35 U.S.C. § 371 National Stage Application of PCT/EP2020/066925, filed on Jun. 18, 2020, which claims the benefit of priority to Serial No. DE 10 2019 209 335.3, filed on Jun. 27, 2019 in Germany, the disclosures of which are incorporated herein by reference in their entirety.

The disclosure relates to a hydraulic control block, and to a hydraulic spindle comprising the control block.

A hydraulic spindle, in particular a linear spindle, in particular a compact spindle, has a hydraulic cylinder in a closed hydraulic circuit, or in a partially closed hydraulic circuit in case of necessary compensation of differential volume. With low oil volume, the spindle can be used for pressing, joining or closing with high dynamics, precision and force. Typical applications for such spindles are presses, injection molding machines, hexapods for simulators or the like. If the spindle has an additional servo drive, extremely high positioning accuracy and good electrical/electronic networkability are additionally provided.

A generic servo-hydraulic spindle is shown in the data sheet RD 08137/2018-02 of the applicant. The compactly designed spindle has a servo actuator, a hydraulic control block, as well as a hydraulic cylinder, a hydraulic accumulator and control elements such as valves, and power electronics.

In addition to resolved designs of the spindle, in which the above components are connected to the central control block by means of hoses, lines, pipes, etc., compact designs with direct mechanical and hydraulic and electrical connection to the control block are also possible.

The design and manufacture of the control block must be individually adapted to each specific hydraulic cylinder in terms of pressure medium flow rate and, in particular, the number of working chambers supplied with pressure medium, which is cost-intensive.

By contrast, the disclosure addresses the problem of creating a more favorable hydraulic control block for a hydraulic or servo-hydraulic spindle, as well as a corresponding spindle comprising said block.

The first problem is addressed by a hydraulic control block having the features of the disclosure, the second problem by a hydraulic spindle having the features of the disclosure.

Advantageous further refinements of the inventions are described in the disclosure.

A hydraulic control block for controlling the pressure medium supply to a hydraulic cylinder of a hydraulic or servo-hydraulic spindle has a hydraulic circuit structure. This has, in particular, fixed and switchable hydraulic components and means, such as pressure medium channels and valves, which are necessary for the control. According to the disclosure, the circuit structure is generic with reference to several specific hydraulic cylinders with different numbers of piston areas. The generic circuit structure is such that one of several specific hydraulic circuit structures can be electively configured from it. A corresponding circuit structure is assigned to each of the specific hydraulic cylinders respectively.

In other words, the control block contains fixed and switchable hydraulic means, in particular components and pressure fluid channels, for several specific circuit structures. From this set of circuit structures, depending on the specific hydraulic cylinder to be controlled via the control block, a specific circuit structure can be electively selected and configured.

In this way, it is no longer necessary to manufacture a specific control block for each specific hydraulic cylinder with a specific number of piston areas, but a generic control block can be manufactured for different, specific hydraulic cylinders, resulting in effects with regard to the number of parts and reduced costs.

The hydraulic cylinder, of which the pressure medium supply can be or is controlled via the control block, in one refinement has one, two, three or four piston areas. In the embodiment with two piston areas, for example, it is designed as a synchronous or differential cylinder. In the case of three, four or more piston areas, designs as tandem cylinders, rapid-motion cylinders or telescopic cylinders are possible.

In a refinement, in a first configured one of the circuit structures, supply ports of the control block, which are fluidically connectable to a high-pressure side and to a low-pressure side of a hydraulic machine or hydraulic pump, are each fluidically connectable or connected to only one working port of the control block, which in the first circuit structure is fixedly assignable or assigned to one of the piston areas of the hydraulic cylinder. Such a circuit structure can, for example, control the hydraulic cylinder in the embodiment with two piston areas or hydrostatic working chambers and is known to the applicant by the term "A" circuit structure for a differential cylinder and "B" circuit structure for a synchronising cylinder.

In a refinement, in a second configured one of the circuit structures, at least one of the supply ports is fluidically connectable or connected to a plurality of working ports of the control block, each of which is fixedly assignable or assigned to one of the piston areas of the hydraulic cylinder in the second circuit structure. Such a circuit structure may, for example, control the hydraulic cylinder in the embodiment with three or more piston areas or hydrostatic working chambers and is known to the applicant as the "E" circuit structure.

In a further refinement, the control block has one, in particular exactly or only one, detachable closure means, and one of the circuit structures is configurable or configured by means of the elective arrangement and/or detachment of said closure means and an associated hydraulic closure, at least in sections, of a flow path configured in the control block.

In an advantageous refinement, the closure means can be arranged or is arranged in a detachable manner accessible from outside the control block.

Preferably, the closure means is a screw or a pressure-resistantly arrangeable stopper.

Alternatively, the closure means may be provided as a valve or valve arrangement that can be actuated as a function of the desired configuration.

In a refinement, the control block has a first and a second supply interface, the first of which is fluidically connectable or connected to a high-pressure side of a hydraulic machine of the spindle and the second of which is fluidically connectable or connected to a low-pressure side of the hydraulic machine, and/or vice versa.

In a refinement, the control block has a first working flow path or pressure medium channel that is fluidically connectable or connected to the first supply interface, and a second working flow path or pressure medium channel that is fluidically connectable or connected to the second supply interface. Via the two working flow paths or pressure medium channels, at least hydraulic cylinders with two, in particular opposing, piston areas can thus be supplied with pressure medium. Examples here include the differential cylinder and alternatively the synchronising cylinder.

In order to also provide a third piston area, especially in the case of a tandem cylinder, with pressure medium via the hydraulic machine, in a refinement the control block has a third working flow path or pressure medium channel, which can be fluidically connected or is fluidically connected to the first supply interface parallel to the first working flow path or pressure medium channel.

Preferably, the first and third working flow paths or pressure medium channels branch off from a common junction.

In a refinement of the control block, at least one of the supply ports is fluidically connectable or connected either to only one or to several of the working flow paths depending on the configured circuit structure.

In a refinement, the control block has a recirculating flow path via which the second working flow path is fluidically connectable or connected to the third working flow path.

This can be used in particular to optimize the energy of an "A" circuit structure with connected differential cylinder.

For this purpose, in a refinement, the recirculating flow path can be switched depending on the cycle.

A permanent connection or coupling of the recirculating flow path, in the case of an "A" circuit structure with differential cylinder, is equivalent to a short circuit, and, in the case of an "E" circuit structure, is equivalent to the operation of a synchronising cylinder.

In a refinement, a differential volume, in particular from the recirculating flow path, is received by a hydraulic accumulator.

In a refinement, the control block has a recirculation valve in the recirculating flow path for controlling the recirculation, which recirculation valve can be switched, i.e. can be blocked and/or opened.

The recirculation valve can be, for example, an electromagnetically actuatable directional control valve, in particular a switching or logic valve. It can be a 2/2-way valve with one, in particular spring-biased, blocking position and one actuatable flow position. Alternatively, it can be a 4/2 directional control valve with two flow positions, one of which is a basic position, in particular spring-loaded, in which the second and third working flow path are each connected to themselves, wherein in the actuatable flow position the second and third working flow paths are connected via two flow cross sections. Alternatively, a poppet valve is possible.

The control of the recirculation valve, but also of all other valves mentioned in this document, can be electric, hydraulic or pneumatic.

In a refinement, at least one first working port branches off from the first working flow path, at least one second working port branches off from the second working flow path, and at least one third working port branches off from the third working flow path.

The working ports are fluidically connectable or connected to one of the piston areas in each case, and/or they are closable or closed, depending on the circuit structure configured in each case. The aforementioned closure is used for simple shutdown/deactivation of the relevant working port.

In a refinement, the working ports are grouped into groups, each of which is associated with one of the configured circuit structures. Preferably, the groups have at least the first working port and the second working port, wherein at least one of the groups has the third working port. Also groups with four working ports or more are possible, depending on the number of piston areas of the assigned hydraulic cylinder.

Despite a large number of configurable circuit structures, a refinement in which the groups have an overlap has proven to be less complex in terms of manufacturing technology. Thus, at least one of the working ports is open and connectable to multiple specific hydraulic cylinders, i.e., in different specific configured circuit structures.

In particular, the overlap includes the first and second working ports, so that for hydraulic cylinders with at least two piston areas the necessary pressure medium connection to the low-pressure and high-pressure sides of the hydraulic machine is ensured.

The groups can be arranged on different sides of the control block for clarity.

In a refinement, a valve is arranged in the third working flow path, via which said flow path can be blocked and opened. This can be a directional control valve, in particular an electromagnetically actuated directional control valve, in particular a switching valve. It can be a 2/2-way valve with a, in particular spring-loaded, blocking position and an actuatable flow position. The design and actuation alternatives already mentioned above also apply to this valve.

In a refinement of the control block, a connecting flow path is provided which branches off from or connects to the first working flow path, and which opens out into the third working flow path opens in a portion of the third working flow path between the last-mentioned valve and the third working port.

In a refinement, the recirculation channel can be blocked and opened in the third working flow path depending on the actuation of the last-mentioned valve.

In a refinement, a receptacle for a closure means, in particular the one according to the previous description, is provided in each case in the first working flow path and in the connecting flow path, wherein the closure means is electively arranged in only one of the receptacles.

Preferably, the receptacles are of the same design so that only a single closure means needs to be provided for elective arrangement in the receptacles.

If the receptacles have different designs, two closure means must be provided, of which only one is ever arranged in place and the other removed when the circuit structure is configured. In this way, an accidental incorrect screw connection can be avoided to an even better extent.

In a first configured one of the circuit structures, the third working port or the third working ports are closed and the closure means is arranged in the receptacle in the first working flow path, wherein the receptacle in the connecting flow path is free. This corresponds to the "A" or "B" circuit structure already discussed further above, wherein the valve in the third working flow path is then responsible for blocking or supplying the pressure medium from/to the working chamber of the hydraulic cylinder connectable or connected to the first working port.

In a second configured one of the circuit structures, the receptacle in the first working flow path is unobstructed and the closure means is arranged in the receptacle in the connecting flow path. This corresponds to the "E" circuit structure already discussed further above, wherein the valve in the third working flow path is then responsible for connecting or disconnecting the third working port to/from the first supply interface.

In a refinement, in particular in the "E" circuit structure, the first working flow path forms the inlet of a filter, in particular one that can be arranged or is arranged in the control block. Alternatively, in the "A" or "B" circuit structure, portions of the first working flow path, the third working flow path and the connection flow path form the inlet of a filter, which can be arranged or is arranged in the control block in particular. In both cases, the filter can thus always be arranged between the high-pressure side and one of the piston areas to which pressurized medium can be applied, whereby a pressure medium flow rate sufficient for filtering is always provided via the filter, regardless of the configured circuit structure.

In a refinement, the control block has an accumulator flow path and a hydraulic accumulator that is fluidically connectable or connected thereto. In particular, the accumulator flow path is fluidically connectable to at least two of the working flow paths, in particular to the first and second, in particular via one check valve each.

In a refinement, electrically or hydraulically actuatable decompression valves are provided, via which the accumulator flow path can be connected to the first working flow path on the one hand and to the second working flow path on the other.

A hydraulic spindle has a hydraulic control block configured according to at least one aspect of the preceding description. Furthermore, the generic circuit structure is configured, by means of the closure means, to a specific circuit structure of a specific hydraulic cylinder, the working chambers of which are fluidically connected to the associated working port in each case. Furthermore, the spindle can have a hydraulic machine, the high-pressure and low-pressure sides of which are fluidically connected to the first and second supply interfaces, respectively.

An exemplary embodiment of a hydraulic control block according to the disclosure and of a hydraulic spindle according to the disclosure is shown in the drawings. The disclosure will now be explained on the basis of the figures of these drawings.

In a refinement, the working ports on the control block are arranged and/or configured so as to allow a first spatial arrangement of the hydraulic cylinder and a second spatial arrangement that is rotated relative to the first, in particular.

In a refinement, at least one safety valve is arranged in the first working flow path and/or in the second working flow path, via which the particular working flow path can be shut off. In particular, two safety valves are provided in the working flow path for redundancy.

DETAILED DESCRIPTION

Figure 1:
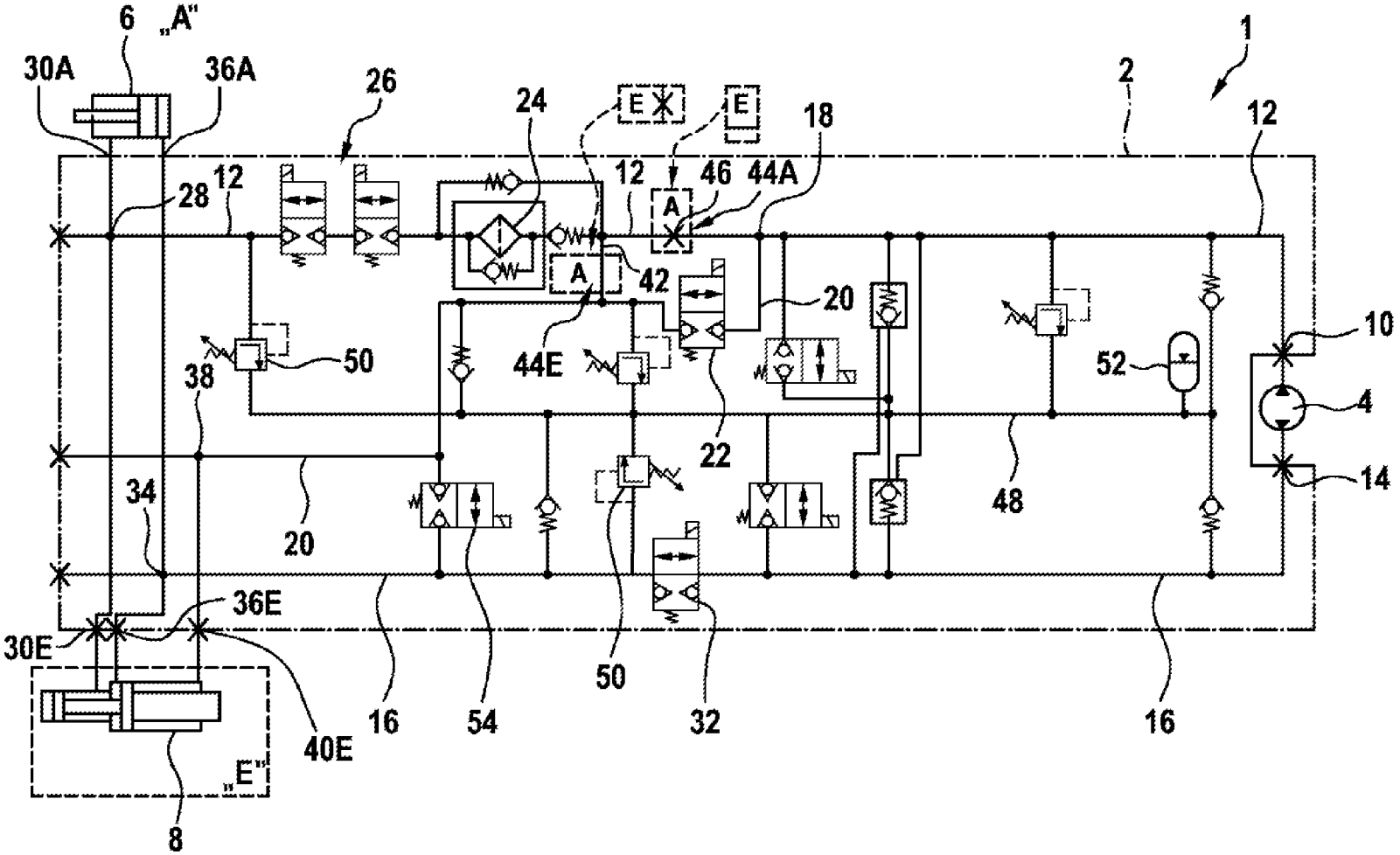
FIG. 1 a hydraulic spindle with a hydraulic control block with generic hydraulic switching structure and two configurable, specific switching structures, FIG. 2 the hydraulic control block according to FIG. 1 in a perspective, partially transparent view, FIG. 3 the hydraulic control block according to FIGS. 1 and 2 in a partially transparent side view, and FIG. 4 the hydraulic control block according to the previous figures in cross-section.

According to FIG. 1, a hydraulic spindle 1 has a hydraulic control block 2, as well as a hydraulic machine 4 connected thereto and a hydraulic cylinder 6, or 8, supplied with pressure medium by said hydraulic machine and optionally connected to the control block 2. The control block 2 has a generic hydraulic switching structure.

The term "generic" is to be understood in this document to mean that several specific switching structures, in the exemplary embodiment shown these two, A and E, can be optionally configured from the generic switching structure, wherein, as already mentioned above, the switching structure A can be designated B when a synchronising cylinder is connected.

In other words, the control block 2 contains all the necessary fixed and switchable hydraulic means, in particular components and pressure medium channels, to be able to configure a plurality of specific switching structures.

A particular switching structure A, E is assigned here to a specific hydraulic cylinder 6 or 8. For example, the hydraulic cylinder 6 has two working ports and the optionally shown hydraulic cylinder 8 has three working ports. Each working port is fluidically connected here to a specific piston area or a specific working chamber of the particular hydraulic cylinder 6,8. Two different hydraulic cylinder types (synchronising/differential) can be connected here in the switching structure A (B).

In detail, the control block 2 has a first supply interface 10 from which a first working flow path 12 originates, and a second supply interface 14, from which a second working flow path 16 originates. The supply interfaces 10, 14 are designed as supply ports. Alternatively, they can be designed as orifices in the control block 2 or the like.

Fluidically connected to them, in each case, is a high-pressure side and low-pressure side of the hydraulic machine 4. Depending on the direction of rotation of the hydraulic machine 4, which is designed with a constant delivery volume, the first supply port 10 can be fluidically connected to the high-pressure side and the second supply port 14 to the low-pressure side, or vice versa. For further consideration it is assumed that the former is the case.

The first working flow path 12 has a branch 18 at which a third working flow path 20 branches off. A valve 22, which is designed as a 2/2-way switching valve, is arranged in this path.

Starting from the branch 18, the first working flow path 12 extends further, wherein a filter 24 is arranged therein. Two series-connected safety valves 26 are arranged in the first working flow path 12 and downstream of the filter 24, via which the first working flow path 12, downstream of the filter 24, and can be used to shut off the first working flow path 12 in redundancy. They are also simply designed as 2/2-way switching valves.

In continuation of the first working flow path 12, this has a branch 28. Two first working ports 30A and 30E branch off from this to a different side each of the control block.

A shut-off valve 32 is arranged in the second working flow path 16, via which valve the second working flow path 16 can be shut off. Starting from the second supply port 14, via the shut-off valve 32, the second working flow path 16 continues up to a branch 34. Two second working ports 36A, 36E branch off from it, each to a different side of the control block 2.

The third working flow path 20 is continued beyond the valve 22, to a branch 38, from which only a third working port 40E branches off to the side of the control block 2 where the ports 30E and 36E associated with the specific circuit or configuration E are already provided.

As already mentioned, optionally and depending on the configuration of the hydraulic cylinder 6 with two piston areas or the hydraulic cylinder 8 with three piston areas, pressure medium can be supplied via the control block 2.

For this purpose, a connecting flow path 42 is provided, via which the first working flow path 12 is fluidically connectable to third working flow path 20 downstream of valve 22. A receptacle 44E is provided in the connecting flow path 42. A receptacle 44A of the same design in the exemplary embodiment is provided in the first working flow path 12 in a portion between the branch 18 and an inlet of the connecting flow path 42.

A closure means 46 in the form of a screw, in particular M18×1.5 (in this case according to DIN906), can be inserted into the corresponding receptacle 44E, 44A. Due to the identical design of the receptacles 44E, 44A with M18 thread in the exemplary embodiment, exactly one closure means 46 can be inserted into the corresponding receptacle 44E, 44A, depending on the desired configuration E, A.

In the exemplary embodiment shown in FIG. 1, the closure means 46 is inserted into the receptacle 44A, thus configuring the circuit structure A to supply hydraulic cylinders having two working chambers or piston areas at the working ports 30A, 36A. Then, the working ports of the circuit structure E 30E, 36E and 40E of the configurable circuit structure E are closed. Accordingly, the hydraulic cylinder 8 is shown with the aforementioned ports optional (dashed outline).

Thus, in the selected configuration A, the pressure medium can no longer flow directly via the first working flow path 12 towards the first working port 30A, but rather must flow via a portion of the third working flow path 20, the valve 22 and the connecting flow path 42 which is unblocked in this configuration A. Accordingly, the valve 22 has the function of either supplying or blocking pressure medium to/from the annular chamber of the hydraulic cylinder 6 supplied by the first working port 30A.

In order to accommodate differential volumes resulting from different piston area sizes of the hydraulic cylinders 6, 8, the hydraulic control block 2 has an accumulator flow path 48 which can be fluidically connected to the corresponding working flow path 12, 16 via pressure relief valves 50 preset to a pressure value. A gas-loaded hydraulic accumulator 52 is connected to the accumulator flow path 48.

In the case of configuration A, all working ports 30E, 36E and 40E used to supply pressure medium to the hydraulic cylinder 8 in configuration E are shut off. The same is true for the third working flow path 20 and its blind bore shown on the left in FIG. 1.

Once the circuit structure E is configured, the hydraulic cylinder 8 having three working chambers or piston areas can be supplied with pressure medium. Then, the closure means 46 is released and removed from the receptacle 44A and inserted into the receptacle 44E. In addition, the working ports 30A and 36A are closed and the working ports 30E, 36E and 40E are open, wherein the third working flow path 20 is still closed on the part of the blind bore provided in the exemplary embodiment.

The outlets or working ports 30A, 30E, 36A, 36E, 40E can be formed in the control block 2 and can each be designed as an individual pressure medium channel. An extension of the control block 2 to a number of outlets or working ports exceeding this can increase a variability of the control block, in particular to meet market requirements.

In circuit structure E, pressure medium can then flow via the first working flow path 12 via the branch 18 and the filter 24 directly to the first working port 30E and thus into the left annular chamber of the tandem cylinder 8. Since in configuration E the connecting flow path 42 is obstructed by the closure means 46, the position of the valve 22 now decides whether or not the annular chamber connected to the third working port 40E is supplied with pressure medium.

If it is supplied, the identically acting annular chambers of the working ports 30E and 40E are thus provided with pressure medium, which corresponds to a surface summation and thus a power stroke of the hydraulic cylinder 8.

In the case of the power stroke, the hydraulic pump delivers pressure medium from the working chamber of the hydraulic cylinder 8, connected to the second working port 36E, into its working chambers connected to the first working port 30E and third working port 40E. The recirculation valve 54 is closed for this purpose.

In a rapid traverse of the hydraulic cylinder 8, on the other hand, the working ports 36E and 40E are fluidically connected and short-circuited via the recirculation valve 54. The hydraulic pump then delivers pressure medium from the working chamber connected to the second working port 36E to the working chamber connected to the first working port 30E. The very small piston area of the piston limiting this leads to the high travel speed. Filling or suction into the working chamber connected to the third working port 40E is thus carried out, bypassing the hydraulic pump 4, solely via the recirculation volume flow via the recirculation valve 54. The three annular surfaces of the hydraulic cylinder 8 are matched here to each other in such a way that, apart from volumes due in particular to leakage, no differential volume has to be taken up by the hydraulic accumulator 52.

In the configuration or circuit structure A with differential cylinder 6, pressure medium can flow between the working flow paths 12 and 16 via the recirculation valve 54. In this case, the differential volume must always be delivered to the accumulator 52 when the differential cylinder 6 is retracted. The recirculation valve 54 makes it possible to extend the differential cylinder 6 at the same speed as it is retracted with a low travel force.

Figure 2:
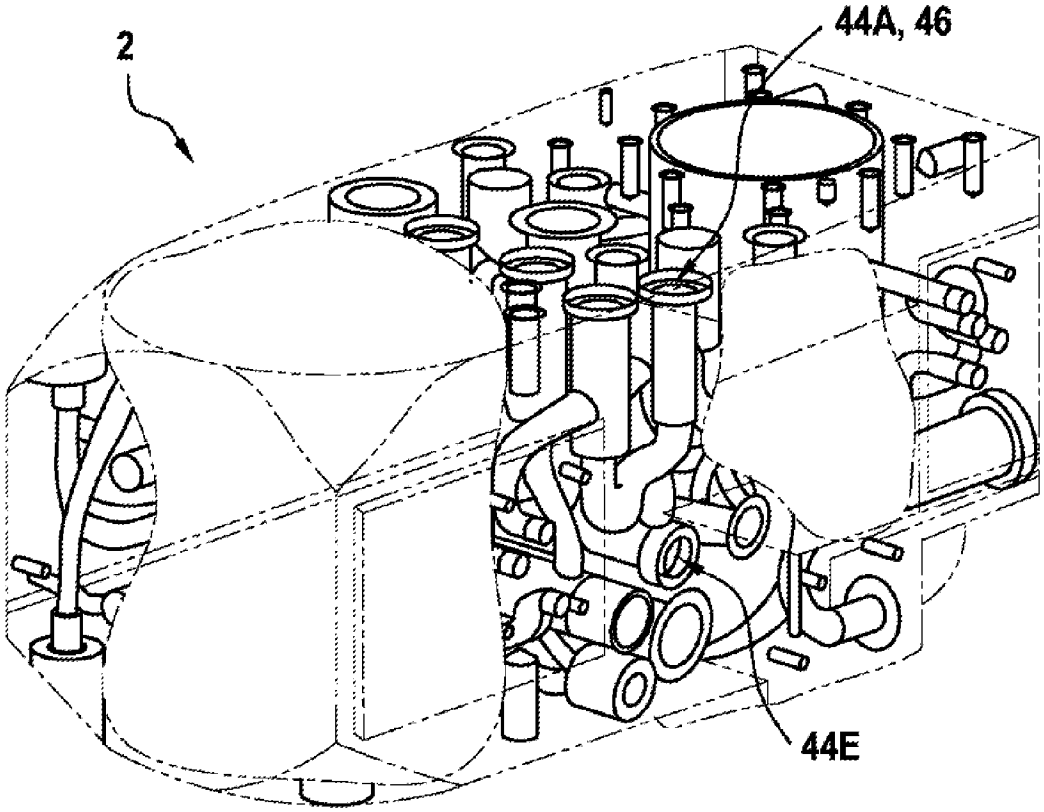
Figure 3:
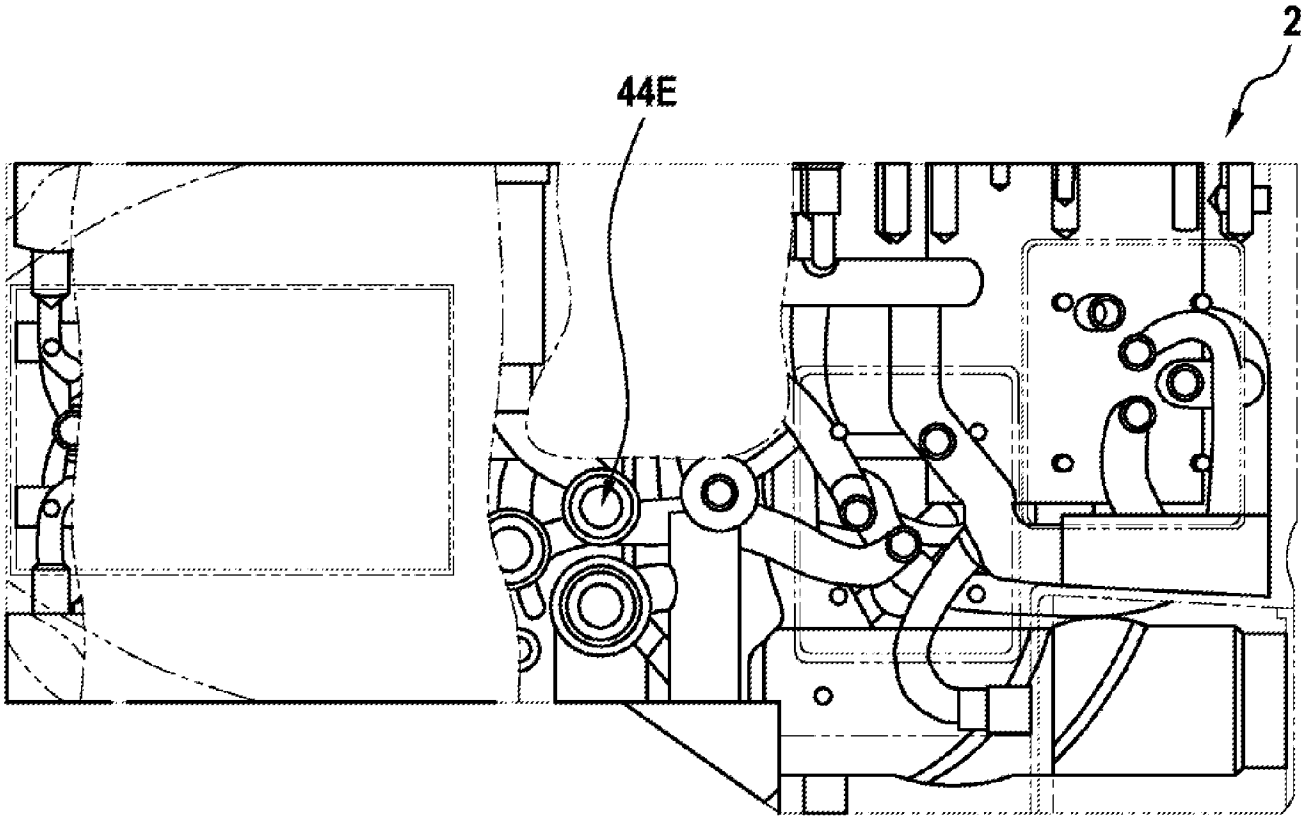

FIGS. 2 and 3 show the hydraulic control block in perspective and in lateral semi-transparent view, wherein the receptacles 44A and 44E are indicated. They are arranged inside the control block 2 and are accessible from the outside via receiving bores. The closure means 46, an M18 screw, can also be inserted and removed via these holes. On the side of the control block 2, distributed over several sides, are hole patterns with connection holes for the valves mentioned in the description of FIG. 1.

Figure 4:
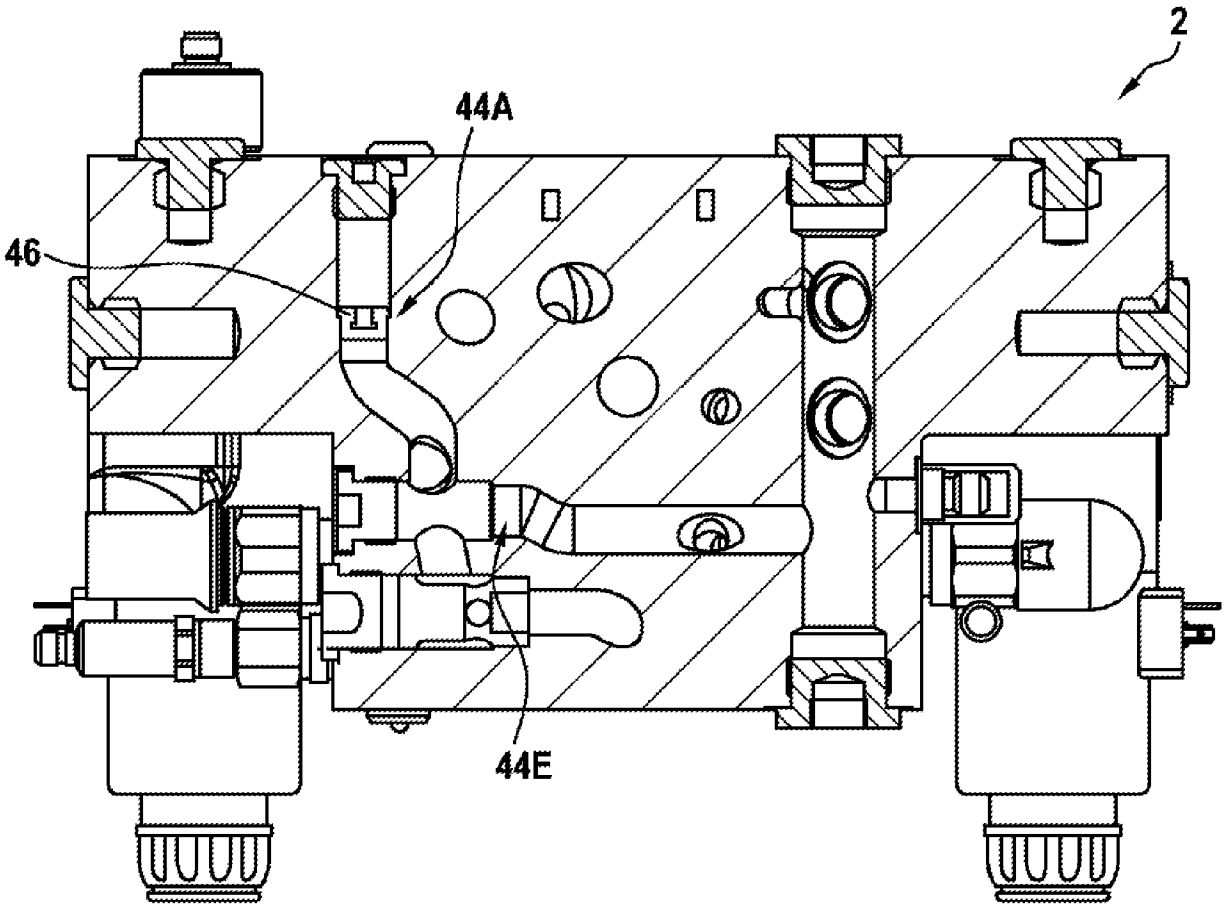

According to FIG. 4, the receptacles 44A and 44E are visible in a cross-section of the control block.

Disclosed is a hydraulic control block having a generic hydraulic circuit structure for a selection of possible hydraulic cylinders and for controlling the pressure medium supply to the hydraulic cylinder, which is prepared so that, by rearranging one of the means, it is possible to change from one specific circuit structure to another specific circuit structure.

Also disclosed is a hydraulic or servo-hydraulic spindle comprising such a control block.

LIST OF REFERENCE SIGNS

1 hydraulic spindle
2 hydraulic control block
4 hydraulic machine
6;8 hydraulic cylinder
10 first supply port
12 first working flow path
14 second supply port
16 second working flow path
18 branch
20 third working flow path
22 valve

24 filter
26 safety valve
28 branch
30A; 30E first working port
32 shut-off valve
34 branch
36A; 36E second working port
38 branch
40E third working port
42 connecting flow path
44A, 44E receptacle
46 closure means
48 accumulator flow path
50 pressure relief valve
52 hydraulic accumulator
54 recirculation valve
n number of piston areas

The invention claimed is:

1. A hydraulic control block for controlling a pressure medium supply of a hydraulic cylinder of a hydraulic spindle, comprising:

a generic hydraulic switching structure electively configurable in each of a plurality of specific hydraulic switching structures, each of the plurality of specific hydraulic switching structures having a respective hydraulic cylinder with a number of piston areas which differs from a number of piston areas in the respective hydraulic cylinders of each of the other of the plurality of specific hydraulic switching structures;

a first supply interface configured to be electively fluidically connected to at least one of a high-pressure side of a hydraulic machine of the hydraulic spindle and a low-pressure side of the hydraulic machine;

a second supply interface configured to be electively fluidically connected to at least one of the high-pressure side and the low-pressure side of the hydraulic machine;

a first working flow path configured to be electively fluidically connected to the first supply interface;

a second working flow path configured to be electively fluidically connected to the second supply interface;

a third working flow path configured to be electively fluidically connected to the first supply interface in parallel with the first working flow path;

at least one first working port branched off from the first working flow path;

at least one second working port branched off from the second working flow path;

at least one third working port branched off from the third working flow path; and a valve in the third working flow path configured to electively close and open said third working flow path.

2. The control block as claimed in claim 1, further comprising:

a releasably arrangeable closure structure configured to electively close at least a portion of a flow path configured in the control block, thereby electively configuring the generic hydraulic switching structure in one of the plurality of specific hydraulic switching structures.

3. The control block as claimed in claim 2, wherein the closure structure is releasably arrangeable from outside the control block.

4. The control block as claimed in claim 1, further comprising:

a recirculating flow path configured to electively connect the second working flow path fluidically to the third working flow path.

5. The control block as claimed in claim 1, wherein the at least one first working port, the at least one second working port, and the at least one third working port are at least one of:

configured to be respectively electively fluidically connected to the piston areas of a respective one of the respective hydraulic cylinders; and configured to be respectively electively closed.

6. The control block as claimed in claim 1, further comprising:

a connecting flow path, via which the first working flow path is electively fluidically connected to the third working flow path in a portion of the third working flow path between the valve and the third working port.

7. The control block as claimed in claim 6, further comprising:

a first receptacle for a closure means in the first working flow path; and a second receptacle for the closure means in the connecting flow path, wherein the closure means is arranged electively in only one of the first and second receptacles.

8. The control block as claimed in claim 7, wherein in a first configured one of the plurality of specific hydraulic switching structures:

the at least one third working port is closed;

the closure means is arranged in the first receptacle in the first working flow path; and the receptacle in the connecting flow path is free.

9. The control block as claimed in claim 8, wherein in a second configured one of the plurality of specific hydraulic switching structures:

the receptacle in the first working flow path is free; and the closure means is arranged in the second receptacle.

10. A hydraulic spindle comprising:

a control block comprising:

a generic hydraulic switching structure electively configurable in each of a plurality of specific hydraulic switching structures, each of the plurality of specific hydraulic switching structures having a respective hydraulic cylinder with a number of piston areas which differs from a number of piston areas in the respective hydraulic cylinders of each of the other of the plurality of specific hydraulic switching structures;

a hydraulic machine connected to the control block;

a first supply interface configured to be electively fluidically connected to at least one of a high-pressure side of a hydraulic machine of the spindle and a low-pressure side of the hydraulic machine;

a second supply interface configured to be electively fluidically connected to at least one of the high-pressure side and the low-pressure side of the hydraulic machine;

a first working flow path configured to be electively fluidically connected to the first supply interface;

a second working flow path configured to be electively fluidically connected to the second supply interface;

a third working flow path configured to be electively fluidically connected to the first supply interface in parallel with the first working flow path;

at least one first working port branched off from the first working flow path;

at least one second working port branched off from the second working flow path;

at least one third working port branched off from the third working flow path; and a valve in the third working flow path configured to electively close and open said third working flow path; and a first of the respective hydraulic cylinders connected to the control block, wherein, the generic circuit structure is electively configured to a number of piston areas of the first of the respective hydraulic cylinder.

* * * * *